United States Patent [19]

Bigham

[11] 4,028,583

[45] June 7, 1977

[54] HIGH POWER-DOUBLE STRAPPED VANE TYPE MAGNETRON

[75] Inventor: Clifford B. Bigham, Deep River, Canada

[73] Assignee: Atomic Energy of Canada Limited, Ottawa, Canada

[22] Filed: Mar. 10, 1976

[21] Appl. No.: 665,621

[30] Foreign Application Priority Data

Aug. 7, 1975 Canada ..... 233018

[52] U.S. Cl. ..... 315/39.69; 313/32; 313/34; 313/103 R; 315/39.53; 315/39.63

[51] Int. Cl.² ..... H01J 23/22

[58] Field of Search ..... 315/39.51, 39.53, 39.63, 315/39.69; 313/103, 105, 32, 34

[56] References Cited

UNITED STATES PATENTS

| | | | |
|---|---|---|---|
| 2,438,194 | 3/1948 | Steele, Jr. et al. | 313/103 |
| 2,523,049 | 9/1950 | Nelson | 315/39.53 |
| 2,534,503 | 12/1950 | Donal, Jr. et al. | 315/39.63 X |
| 2,574,562 | 11/1951 | Hansell | 315/39.63 X |
| 3,305,693 | 2/1967 | Hull | 315/39.69 |
| 3,315,121 | 4/1967 | Staats | 315/39.53 X |
| 3,320,471 | 5/1967 | Mims | 315/39.69 X |
| 3,536,953 | 10/1970 | Van De Goor | 315/39.69 |
| 3,707,639 | 12/1972 | Pickering | 313/32 |

*Primary Examiner*—Saxfield Chatmon, Jr.
*Attorney, Agent, or Firm*—James R. Hughes

[57] ABSTRACT

A magnetron comprising a large vane-type, double-strapped anode structure with the vanes being cooled by liquid flowing in a channel immediately behind the surface bombarded by electrodes and the two pairs of straps passing through openings in the vanes, a liquid cooled secondary-emission cathode positioned centrally of the anode, said cathode incorporating a starting filament connected to a heating current power source, means for engendering an axial magnetic field in the region between anode and cathode, and power output means connected to at least one slot between vanes, said means including a coupling slot, a ridge waveguide transition connected to said slot and a window between the transition and an output waveguide.

2 Claims, 7 Drawing Figures

HIGH POWER-DOUBLE STRAPPED VANE TYPE MAGNETRON

This invention relates to magnetrons and more especially to the design of a high power, high efficiency magnetron for industrial heating purposes.

The use of magnetrons as RF power sources for heating applications such as cooking, drying, curing and accelerated chemical processing is expanding rapidly. Small units such as domestic ovens use 0.5—2.5 KW, S-band magnetrons and large units use 25 KW, 915 MHz magnetrons which are commercially available. These tubes have high conversion efficiency, up to 85% in some instances. There are however promising applications such as wood drying, soil sterilization, and grain drying, amongst others that require much higher powers, beyond that reasonably obtainable with multiple 25 KW installations. The economics of these applications usually rules out the use of klystrons at least at the present stage of development of this type of power source.

It is an object of the present invention to provide a high power magnetron with better than 80% conversion efficiency and a power output of 100 KW and up to the 250 KW range.

This and other objects of the invention are achieved by a magnetron comprising a large vane-type, double-strapped anode structure with the vanes being cooled by liquid flowing in a channel immediately behind the surface bombarded by electrons and the two pairs of straps passing through openings in the vanes, a liquid cooled secondary-emission cathode positioned centrally of the anode, said cathode incorporating a starting filament connected to a heating current power source, means for engendering an axial magnetic field in the region between anode and cathode, and power output means connected to at least one slot between vanes, said means including a coupling slot, a ridge waveguide transition connected to said slot and a window between the transition and an output waveguide.

In drawings which illustrate an embodiment of an invention,

Figure 4:
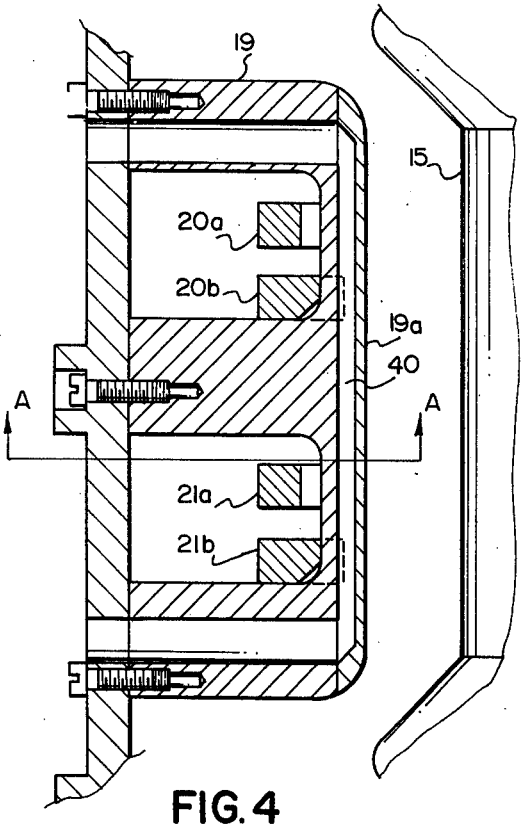
FIG. 4 shows the anode vane and the internally mounted straps.
Figure 4A:
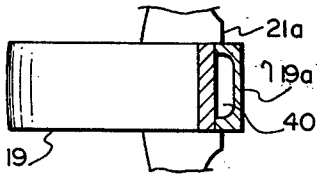

FIG. 4*a* taken on the section A—A illustrates the mounting of strap 21A.

Figure 1:
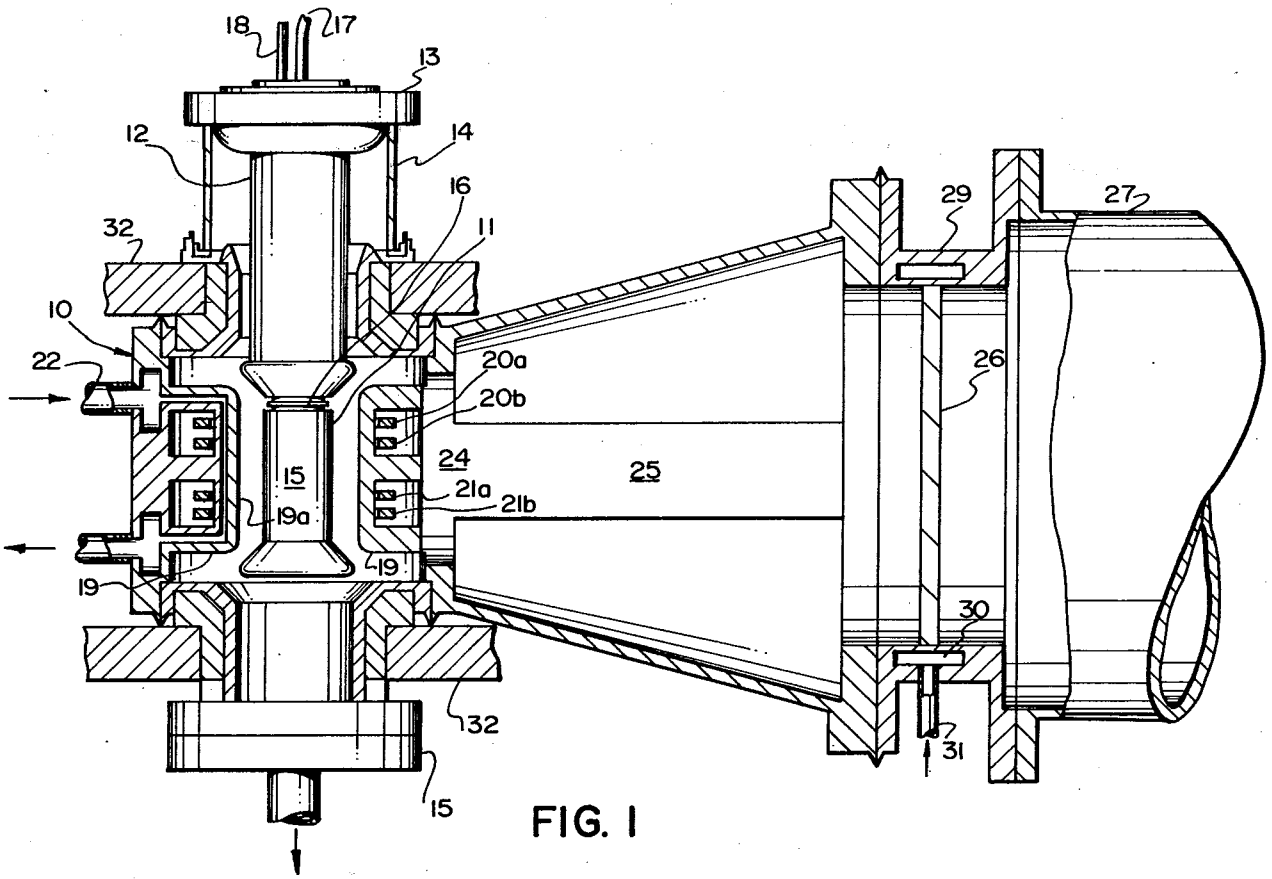
FIG. 1 is a cross-section of the magnetron and output coupling.
Figure 2:
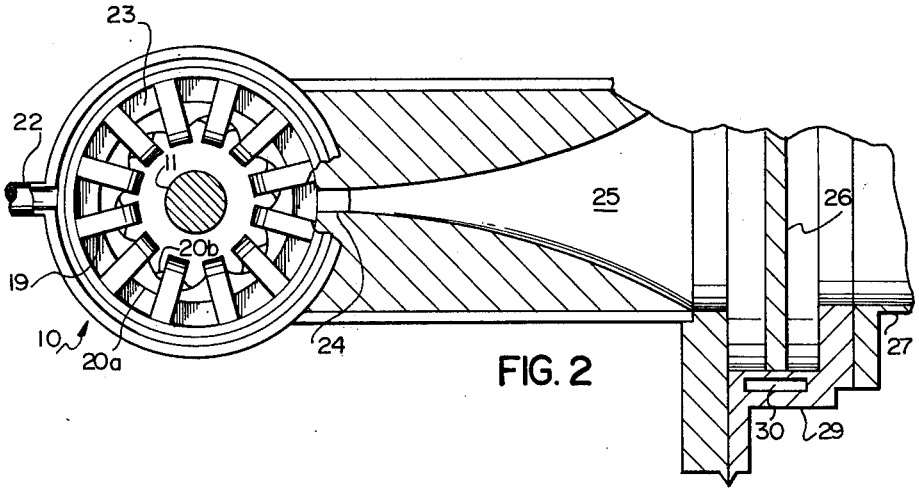
FIG. 2 is a transverse cross-section of the magnetron of FIG. 1.
Figure 6:
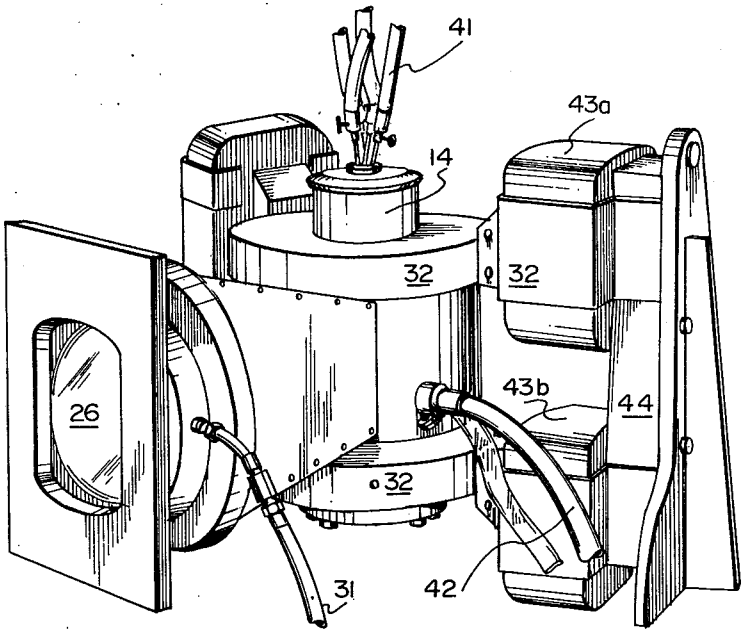
Figure 5:
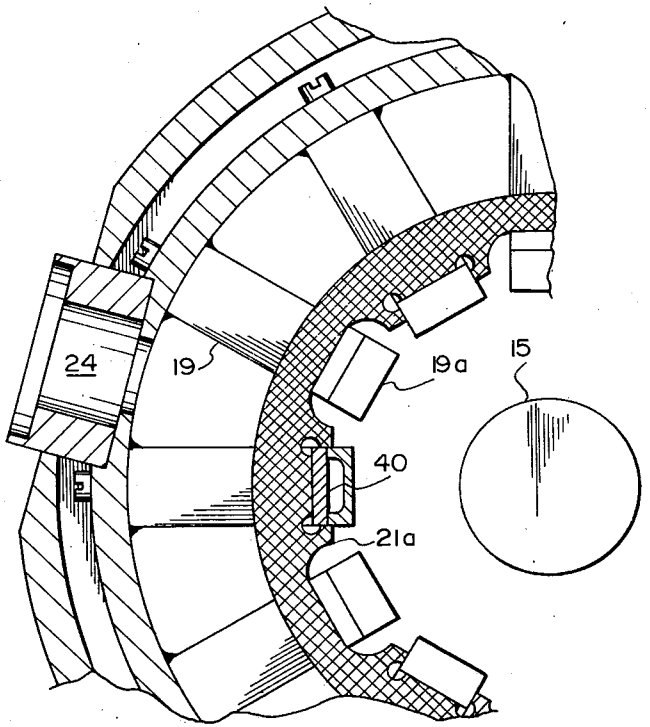

FIG. 5 shows a strap and its connection to the vanes,

FIG. 6 is an external view showing output window and magnetic structure,

Referring to FIGS. 1 and 2, the magnetron is contained in a housing shown generally as 10 in which is positioned a cathode 11 mounted on a cathode mount 12 extending from end plate 13 connected to an alumina insulating sleeve 14.

The cathode comprises a secondary emission (cold cathode) surface 15 and a starting filament 16. Cooling liquid for the cathode enters at 17 and electrical connections for the starting filament at 18.

A bottom flange 15 allows connection to an appendate pump for maintaining the vacuum of the magetron cavity. The anode structure consists of a number (12 shown here) of vanes 19 which are doubly connected (strapped) by straps 20*a* and 20*b* and also 21*a* and 21*b*. As can be specifically seen in FIG. 2 these straps are mounted internally of the vanes. This reduces RF coupling of the anode to the cathode, characteristic of end strapped anodes. This also eliminates the requirement for a cathode choke. Anode cooling water is introduced at 22 to cool the anode by a liquid stream passing directly behind the vane tip 19*a*. The vanes form a series of cavities 23 and the output is taken through a coupling slot 24 in the back of one cavity and a ridged-waveguide transition to the windows 26 of a waveguide 27. This output method has the advantage that there are no delicate probes requiring cooling for high powers but the disadvantage of uneven loading on the RF structure. This is resolved by adding a compensating short between vanes at an empirically determined resonator to even the loading. The output window 26 is an alumina disk brazed to a thin copper tube 29 which is cooled by water flowing in a channel 30 around the circumference and supplied at 31. A magnet yoke 32 energized by coils (not shown) complete the device.

Figure 3:
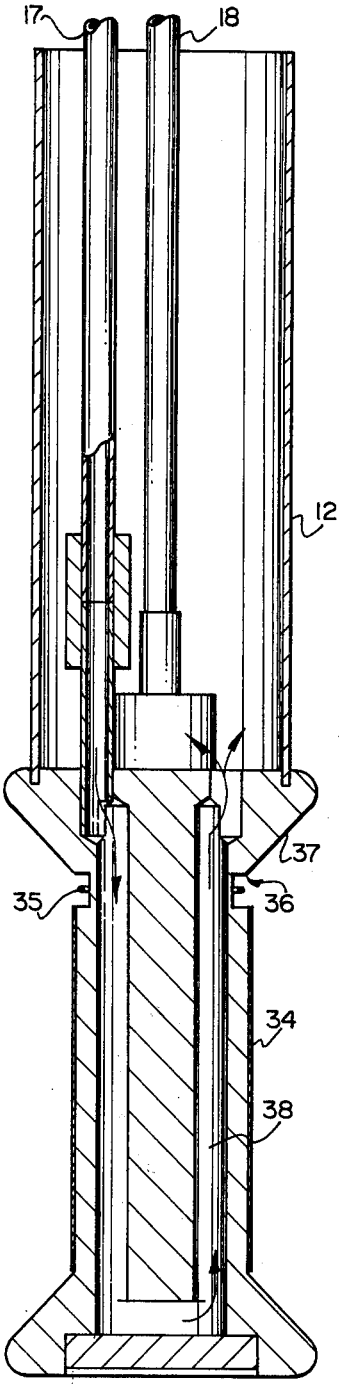
FIG. 3 shows the cathode in more detail.

FIG. 3 shows the cathode 15 in more detail. Secondary emission is known to contribute to the electron circuit in a normal hot-cathode magnetron; the back-bombarding electrons causing the secondary emission also add to the cathode heating requiring a heater power reduction so that temperatures do not get too high. Under fault conditions causing moding, this back bombardment may damage the cathode. In the present device the cathode function is separated into a well cooled secondary emission surface 34 and a small tungsten starter filament 35 mounted in a circumferential groove 36 formed in the surface of the cathode. The preferred metal for the secondary emitter is platinum although other materials e.g. barium tungstate, may be used. The starter filament 35 is formed of two semicircular tungsten wires connected to a d.c. power supply. The cathode is mounted on an alumina bushing 37 and cooled by water flowing as shown in duct 38.

FIGS. 4 and 4*a* taken on the section A—A show the mounting of the straps 20*a*, 20*b* and 21*a*, 21*b*, more clearly. There are two pairs of straps which are connected to alternate vanes. Cooling liquid flows in channel 40.

FIG. 5 shows the output coupling slot connected to one of the resonant countries between vanes.

FIG. 6 is an external view of the magnetron showing the window 26, the cooling and electrical power leads 41 and 42, and the magnetic yoke 32 with coils 43*a*, 43*b* for providing the necessary axial magnetic field.

I claim:

1. A high power double-strapped, vane-type magnetron comprising:

a. an evacuated housing, b. an anode structure mounted in the housing and formed of an even number of vanes defining resonant cavities there-between and at least one pair of circumferential straps passing through openings in the vanes with the straps connected in interleaved relation to alternate vanes, said vanes having cooling channels therein directly behind the anode surface to be bombarded by electrons, c. a cathode structure mounted centrally of said anode, said cathode structure comprising a secondary emission cathode surface and a separate starting filament mounted thereon, d. a coupling slot connecting one of said resonant cavities via a ridged waveguide transition and a window to an output waveguide, and e. means for applying an axial magnetic field in the region between the anode and cathode.

2. A magnetron as in claim 1 wherein the number of vanes is 12 and there are two pairs of straps.

* * * * *